United States Patent [19]

Willox

[11] 4,231,208

[45] Nov. 4, 1980

[54] GUY GUARD AND METHOD OF INSTALLING SAME

[76] Inventor: J. Hebden Willox, 917 Newcastle Ave., Westchester, Ill. 60153

[21] Appl. No.: 677,566

[22] Filed: Apr. 16, 1976

[51] Int. Cl.[2] ..... E04H 12/20

[52] U.S. Cl. ..... 52/741; 29/453; 29/455 R; 52/98; 52/147; 174/136; 264/230; 264/249

[58] Field of Search ..... 52/147, 98–100, 52/741, 747; 47/23, 24, 25; 174/136, 5 R; 264/230, 249; 29/453, 455

[56] References Cited

U.S. PATENT DOCUMENTS

| | | | |
|---|---|---|---|
| 1,435,311 | 11/1922 | Knight | 174/5 R |
| 1,988,435 | 1/1935 | Beebe | 174/136 |
| 3,010,546 | 11/1961 | Phillips | 52/147 |
| 3,251,161 | 5/1966 | Stirn | 52/147 |
| 3,512,318 | 5/1970 | Turner | 52/100 |
| 3,900,697 | 8/1975 | Yotsugi | 174/136 |

FOREIGN PATENT DOCUMENTS

| | | | |
|---|---|---|---|
| 424293 | 2/1935 | United Kingdom | 174/5 R |

OTHER PUBLICATIONS

Transmission & Distribution, Nov. 1975, p. 59.

*Primary Examiner*—James A. Leppink
*Assistant Examiner*—Henry E. Raduazo
*Attorney, Agent, or Firm*—Andrew J. Bootz

[57] ABSTRACT

There is provided an improved guy guard for a guy wire of a utility pole and the like and formed of an elongated tubular plastic guard member having a longitudinally frangible web and differentially stressed to bias the guard member to curl around itself when the web is fractured. The guard member is installed on a guy wire by progressively forcing the guy wire through the frangible web thereby releasing the wrapping action.

2 Claims, 9 Drawing Figures

10
12
14
15
16
17
18
20
21
22
25
26

GUY GUARD AND METHOD OF INSTALLING SAME

BACKGROUND AND PRIOR ART

Guy guards are generally provided on guy wires of utility poles, and normally are required by electrical codes. Such guards make the guy assembly more readily visible and afford protection to a person who may accidentially run into it.

Installation of the guards are usually over existing or previously installed guy wires; thus it becomes necessary to install and lock the guy guard to the guy wire. Moreover such guy guards extend from at or near ground level upwardly on the guy wire, and must be tamper proof to discourage their unauthorized removal or destruction.

Such guy guards are used in large numbers, and although the cost of each guard is not great, it is desirable to reduce the cost so as to provide a low cost economical guard.

Plastic guy guards are presently commerically available for installation over a guy wire. Such prior art plastic guards present certain installation difficulties, and commonly have an upper clamp and a lower clamp or bolting means for locking the guy guard to the guy assembly, which clamps add to the overall cost of the installed guy guard.

SUMMARY OF THE INVENTION

In accordance with the present invention there is provided an improved guy guard for installation over a guy assembly of a utility pole or the like. The guy guard is of extruded plastic formed as an elongated tubular member. A longitudinally extending frangible web is provided on the tubular member. The guy guard is differentially stressed by a known technique during extrusion to bias the guard member to a tendency to wrap upon itself when the frangible web is fractured. The wrapping tension is held by the frangible web until the web is fractured, whereupon the tension is released and the guy guard will wrap upon itself and lock around a guy assembly.

A single metal clamping device may be used, preferably at the upper end of the guard out of normal reach from the ground.

The invention is also directed to an improved method of installing a guy guard over a guy wire. Briefly the guy guard is extruded with a longitudinal frangible web and is differentially stressed to bias the guard member to a tendency to wrap upon itself when the web is fractured. The guy wire is progressively forced through the frangible web to simultaneously fracture the web and assemble the guard member over the guy wire. Fracture of the web releases the prestressed wrapping tension of the guard member causing the longitudinal edges of the guard along the fractured web to overlap and wrap, thereby locking the guard member to the guy assembly.

Guy wires typically terminate at their lower end in an eye, commonly a "thimbleye", attached to an anchor rod in the ground. Advantageously the guard member may be installed on the guy wire above the anchoring assembly and thereafter the guard member may be forced downwardly, and over, and beyond the clamping or dead ending means and the anchoreye so as to permit the guard to wrap around the anchor rod itself and firmly lock there on.

Advantageously there is provided an economical, extruded plastic guy guard. The conventional lower locking means has been eliminated saving on both initial cost and installation. The differentially stressed guard member, held apart by the frangible web, may be readily installed progressively on a guy wire. The guard is tamper proof; once the web is fractured and the longitudinal edges overlap themselves, the guard can be removed only with difficulty, and then only with a knowledge of its operation. The absence of a lower clamp further minimizes the possibility of tampering; the upper clamp is out of reach from the ground. When forced over and below (even into the ground) the thimbleye and deadending means, a very tight lock to the guy assembly is provided.

DETAILED DESCRIPTION OF THE DRAWINGS

DETAILED DESCRIPTION OF PREFERRED EMBODIMENT

Figures 1, 2, 3, 4, 5, 6, 7, 8, 9:
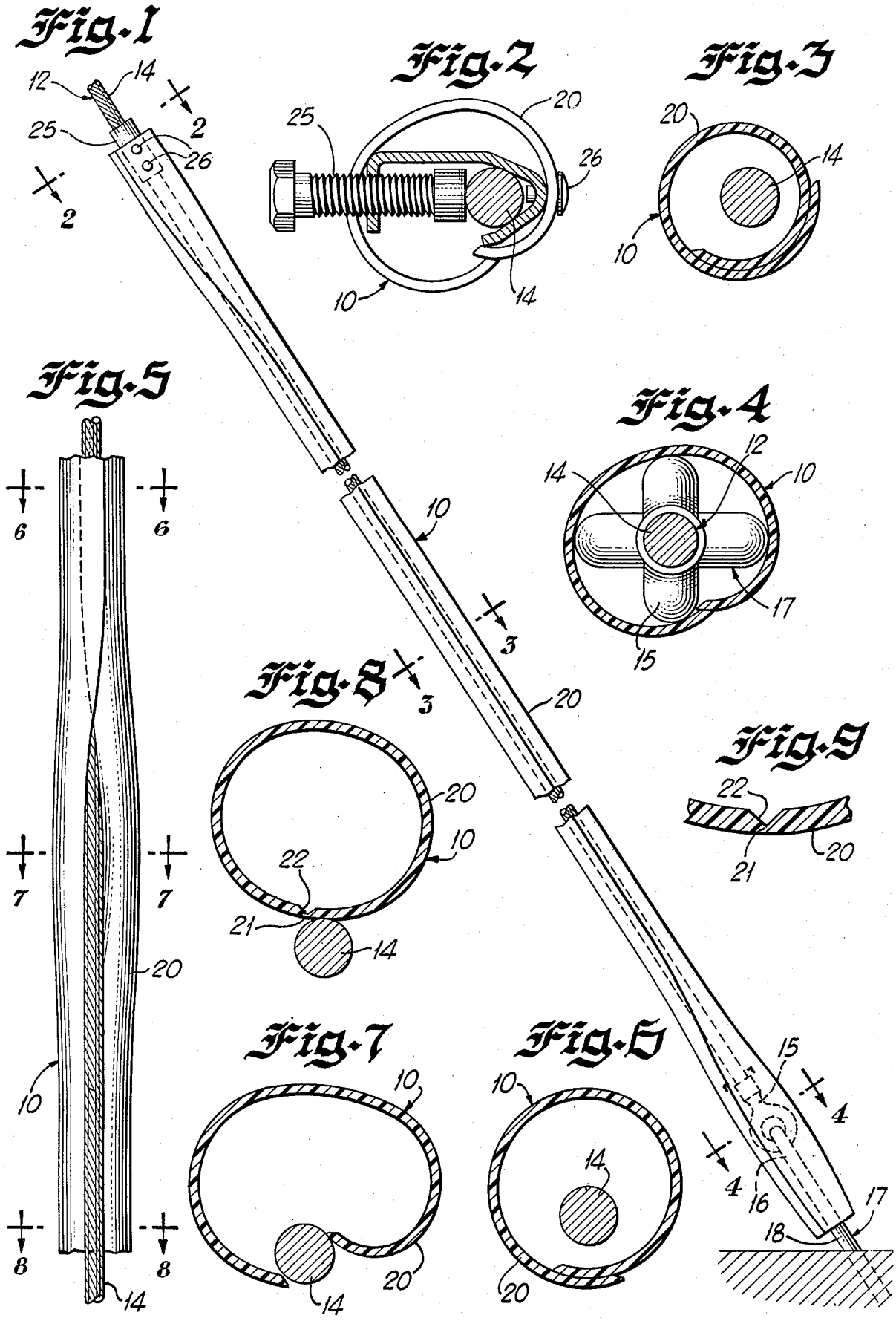
FIG. 1 is a fragmentary view of an improved guy guard installed on a guy assembly according to the present invention.
FIG. 2 is a sectional view of the guy guard and guy wire assembly taken along line 2—2 of FIG. 1.
FIG. 3 is a sectional view of the guy guard and guy wire assembly taken along line 3—3 of FIG. 1.
FIG. 4 is a sectional view of the guy guard and guy wire assembly taken along line 4—4 of FIG. 1.
FIG. 5 is a fragmentary view of the improved guy guard during the process of installation on a guy assembly.
FIG. 6 is a sectional view of the assembly step taken along line 6—6 of FIG. 5.
FIG. 7 is a sectional view of the assembly step taken along line 7—7 of FIG. 5.
FIG. 8 is a sectional view of the assembly step taken along line 8—8 of FIG. 5.
FIG. 9 is an enlarged detail illustrating the frangible web of the guard member.

Referring now to the drawings there is fragmentarily illustrated in FIG. 1 a guy guard 10 according to the present invention installed on a conventional guy assembly 12 of a utility pole (not shown) or the like. The guy assembly 12 includes a guy wire 14 terminating at its lower end in a clamping or dead-ending means 15 to the eye 16 of an anchor rod 17 anchored in a known manner in the ground.

In accordance with the present invention, the guy guard includes an elongated tubular guard member 20 formed of suitable plastic such as polyethylene and extruded nominally cylindrically, having a frangible web 21, FIG. 9, typically defined by a Vee groove or notch 22, here shown as formed on the inner surface.

The guard member is differentially stressed in a known manner biasing the guard member to a tendency to curl inwardly, so that the longitudinal edges along the frangible web 21 will overlap one another as shown in FIGS. 3 and 6 after the frangible web has been fractured. The tension however is held apart by the frangible web 21 until released by fracturing of the web 21 during the process of installation.

A clamp 25 is secured to the upper end of the guard member 20 as by rivets 26. The clamp 25 provides for securing the upper end of the guy guard 10 to the guy wire 14.

In installation, as best shown in FIG. 5, the guy wire 14 is progressively forced through the frangible web 21, simultaneously fracturing the frangible web 21, as shown in FIG. 7. The edges along the fractured web 21 will immediately begin to overlap, as represented by FIG. 6, and the differential stress will continue the wrapping process for a short period of time until the initial forces have balanced themselves, and the guard member 20 takes a final cross sectional position typically illustrated in FIG. 3. The assembly step is continued for the length of the guard until the guard member is completely assembled on the guy wire 14. In a preferred installation process, installation starts at the top (clamp) end of the guy guard, and the guy guard is pushed upwardly during assembly onto the guy wire; the guard is then brought down into final position.

If it is desired to cover the thimbleye or deadending assembly, thus affording greater security and more positively locking the guard member to the guy assembly 12, the guard member 20 may now be forced downwardly over these components, swelling the guard member 20, FIG. 4, as it passes over these parts. The portion of the guard member 20 below the eye 16 attached to the anchor rod 17 will again wrap around the shank of the anchor rod 17 firmly locking the lower end of the guard member to the guy assembly.

With the guy guard 10 in place on the guy assembly 12, the clamp 25 at the upper end of the guy guard may be secured to the guy wire 14 further locking the guy guard 10 in place. A typical installation will use an eight foot length of guard member 20 so that the clamp 12 is out of easy reach from the ground, thus further minimizing tampering.

The plastic is quite stiff, and unauthorized removal is extremely difficult, particularly since a vandal cannot conveniently study the guard ends and is not familiar with the removal technique.

The elimination of metal parts contributes to a low initial cost and installation cost. Moreover the elimination of a lower attaching means permits forcing of the guard member 20 over the entire clamping or deadending means 15 and the anchor rod eye 16 to attain full coverage of the guy assembly 12 from the ground up.

What is claimed as new and desired to be secured by Letters Patent of the United States is:

1. A method of assembling a guy guard over a guy assembly of a utility pole or the like, comprising the steps of extruding a generally cylindrical length of an elongated plastic guard member with an elongated frangible web, differentially stressing said guard member to bias said guard member to a tendency to wrap upon itself, and progressively fracturing said frangible web simultaneously forcing the guy wire through said frangible web when installing, whereupon the longitudinal edges of said frangible web will wrap and overlap themselves to securely fasten said guard member around said guy assembly.

2. A method as set forth in claim 1 wherein the guy wire terminates in a dead-ending device secured to an anchor rod, and said method includes the steps of assembling said guard member over said guy wire above said anchor rod, and thereafter forcing said guard member downwardly over said assembly so that the guard member can wrap around the anchor rod locking the guard member to it.

* * * * *